US006076311A

United States Patent [19]

Godfrey

[11] Patent Number: 6,076,311

[45] Date of Patent: Jun. 20, 2000

[54] FLOOR FRAME ASSEMBLY FOR A MANUFACTURED HOME

[76] Inventor: Robert E. Godfrey, 56484 C.R. 193, Bristol, Ind. 46507

[21] Appl. No.: 09/135,943

[22] Filed: Aug. 18, 1998

[51] Int. Cl.[7] ..... E04B 1/19

[52] U.S. Cl. ..... 52/143; 52/79.12; 52/653.1; 52/690; 52/650.1; 280/789

[58] Field of Search ..... 52/143, 79.12, 52/263, 653.1, 690, 650.1; 280/789, 799, 795

[56] References Cited

U.S. PATENT DOCUMENTS

| | | | |
|---|---|---|---|
| 2,241,617 | 5/1941 | Rubin | 52/650.1 |
| 2,731,680 | 1/1956 | Bolt . | |
| 2,985,375 | 5/1961 | Gardner | 280/789 |
| 3,042,423 | 7/1962 | Bock . | |
| 3,308,583 | 3/1967 | Chaney | 52/650.1 X |
| 3,316,680 | 5/1967 | Chrastek . | |
| 3,425,179 | 2/1969 | Haroldson . | |
| 3,461,636 | 8/1969 | Hern | 52/650.1 |
| 3,606,704 | 9/1971 | Denton . | |
| 3,751,870 | 8/1973 | Vesel | 52/656 |
| 3,830,024 | 8/1974 | Warnke . | |
| 4,015,375 | 4/1977 | Lindsay | 52/143 |
| 4,019,299 | 4/1977 | Lindsay . | |
| 4,027,439 | 6/1977 | Willard . | |
| 4,033,081 | 7/1977 | Perkins, Jr. | 52/79.12 X |
| 4,106,258 | 8/1978 | Lindsay | 52/693 |
| 4,232,884 | 11/1980 | DeWitt . | |
| 4,517,781 | 5/1985 | LeBlanc . | |
| 4,630,548 | 12/1986 | Wiger et al. . | |
| 4,930,809 | 6/1990 | Lindsay . | |
| 5,028,072 | 7/1991 | Lindsay . | |
| 5,113,625 | 5/1992 | Davis . | |
| 5,201,546 | 4/1993 | Lindsay . | |
| 5,353,558 | 10/1994 | Shea, Sr. et al. . | |
| 5,468,008 | 11/1995 | Hecht . | |
| 5,474,331 | 12/1995 | Booher . | |
| 5,488,809 | 2/1996 | Lindsay . | |
| 5,579,622 | 12/1996 | DeVon et al. . | |
| 5,640,814 | 6/1997 | Godfrey | 52/143 |

FOREIGN PATENT DOCUMENTS

| | | | |
|---|---|---|---|
| 566454 | 1/1957 | Italy | 52/650.1 |

*Primary Examiner*—Carl D. Friedman
*Assistant Examiner*—Phi Dieu Tran A
*Attorney, Agent, or Firm*—Price, Heneveld, Cooper, DeWitt & Litton

[57] ABSTRACT

A floor frame assembly for modular housing units that includes longitudinally extending floor support beams, an outer end beam comprised of a pair of generally parallel angled members, and transverse supports that have a first end attached to and extending outwardly from an outer one of the longitudinal floor support beams and a second end attached to the angled members to support an edge section of the floor assembly. The second end has a height less than the height of the first end. For further support, the floor frame assembly includes vertical first stabilizing members installed at the second end of the transverse supports to keep the transverse supports from buckling. Also, the floor frame assembly includes a plurality of vertical second stabilizing members installed orthogonally to the compression blocks between a sill plate assembly of the foundation and an upper edge section of a corresponding one of the transverse supports for preventing the sill plate assembly from rotating as pressure is applied to it during, e.g., back filling of earth against the foundation.

9 Claims, 4 Drawing Sheets

FLOOR FRAME ASSEMBLY FOR A MANUFACTURED HOME

BACKGROUND OF THE INVENTION

Field of the Invention

The present invention relates to an improved floor frame assembly for prefabricated manufactured homes.

Currently available manufactured homes, with their improved construction methods and quality control, can now closely approximate the look and feel of a conventionally built home, and can be constructed at a substantial savings compared to a conventionally built home. In addition, some available units accommodate the wishes of customers who prefer the larger and wider floor space afforded by traditional homes by building the manufactured homes in modules or sections that are shipped to the home site and joined together on an existing foundation to form a double-wide home.

Typically, each half of the home comes equipped complete with exterior and interior walls and flooring, a roof, and many fixtures including the plumbing and appliances. An axle and wheel assembly is attached to each half so that the unit can be separately towed to the home site and joined together over an existing foundation. Accordingly, the floor frame assembly must be strong enough to support the assembled home over a typical foundation, and must also be strong enough to survive the rigors of being shipped from the factory to the home site without excessive flexing, which could damage the superstructure, the interior walls, and the fixtures. Furthermore, the floor frame must be designed so that the two halves can be readily joined together at the home site with a minimum of additional on-site labor.

Floor frame assemblies for shipping manufactured homes are generally well known in the art, offering a wide variety of designs, some of which include recent developments in ease of assembly and integrity of structure. One such improved frame assembly is shown and described in U.S. Pat. No. 5,640,814 assigned to Schult Homes Corp, which is expressly incorporated herein by reference. The frame assembly includes a plurality of interconnected I-beams and transverse beams positioned orthogonally to each other. In such an arrangement, the outer transverse beams are each independently connected, via a substantially vertical hanger member, to a sill plate assembly which extends around and is tied to the perimeter of the foundation. Although the floor frame assembly of U.S. Pat. No. 5,640,814 includes some desirable attributes with respect to its overall design by achieving a degree of frame stiffness not realized by other known systems, improvements were desired. For instance, because a separate hanger is attached to a different one of the outer transverse beams, the transverse beams each carry a section of the floor load independent of the other transverse edge beams, i.e., each of the outer transverse beams are individual outrigger members. As a result, each outer transverse beam must be separately aligned when the frame is mounted to the floor. Also, in such an arrangement the sill plate assembly is susceptible to rotating relative to the foundation during back filling of earth against the foundation wall.

Assembling known systems is relatively labor-intensive. Although the attachment of the hangers of U.S. Pat. No. 5,640,814 to the sill plate assembly is facilitated by its design, factory labor must still crawl underneath the system and manipulate a tool(s) around the transverse edge supports to fasten the hangers back into an upwardly-extending section of the sill plate assembly. Other systems include a perimeter support beam that has upper and lower flanges and a longitudinally extending vertical web, thus affording no access from outside the structure to the members of the frame structure beneath the floor. Therefore, certain components of the frame structure must be assembled by crawling underneath the structure. These operations are extremely awkward and time-consuming, thus adding difficulty, expense and inefficiency to the assembly of the system.

Accordingly, there remains a need for a manufactured home floor frame assembly that is unitized such that the outside transverse edge supports are collectively attached, the transverse members remain aligned and which is adapted for ready assembly with a like floor frame unit to form a double-wide manufactured home by including fasteners that can be efficiently attached.

SUMMARY OF THE INVENTION

The improved floor frame assembly of the present invention affords increased overall rigidity and support for a manufactured home and is more readily assembled than available designs. The present invention provides a floor frame assembly including an outer side beam that is installed generally coincidentally with the perimeter of the manufactured home, and generally parallel to a plurality of I-beams. To unitize the assembly, the outer transverse edge supports are collectively connected to the outer side beam and to floor joists which overlie the supports. In this arrangement, the outer transverse edge supports are collectively loaded to maximize the integrity of the structure under heavy loads. To insure efficient assembly at the factory, the members of the system can be conveniently attached to each other and the other elements of the system from outside of the structure.

More particularly, the floor support system includes a plurality of longitudinally extending I-beams extending in substantially parallel spaced relationship, a plurality of tapered transverse beams extending orthogonally to the longitudinal I-beams, and at least one outer side beam extending longitudinally and generally coincidentally with a section of a perimeter of the floor support system. Each transverse beam has one end and an opposite end coupled to adjacent longitudinal I-beams, respectively, and wherein at least some of the transverse beams are continually tapered in height such that the one end is substantially the same height as an adjoining longitudinal I-beam and the opposite end has a height about one-half the height of an adjoining longitudinal I-beam and less than the height of the longitudinal I-beam. In addition, the system includes a plurality of outer transverse beams, each having a first end coupled to and extending outwardly from an outer one of the longitudinal I-beams and a second end, opposite the first end, coupled to the side beam, wherein each of the outer transverse beams is tapered in height with its first end having a height substantially the same as the outer one of the longitudinal I-beams and its second end having a reduced height.

According to a further aspect of the invention, the additional transverse beams include a generally vertical central section and first and second longitudinal sections formed integrally with and extending orthogonally to the central section. Also, the outer side beam includes independent and generally parallel spaced upper and lower longitudinally extending angled members coupled to the first and second longitudinal sections, respectively, at the second end of the additional transverse beams.

According to a still further aspect of the invention, the floor support system includes a plurality of first stabilizing members arranged orthogonally between the first and second angled members of the outer side beam for maximizing the integrity of the structure at its perimeter. Further, the system includes a plurality of second stabilizing members each arranged orthogonally to a corresponding first stabilizing member, and each having first and second opposed abutting ends which, when installed, contact a section of a sill plate assembly and a section of one of the additional transverse beams, respectively, for preventing rotation of the sill plate assembly.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
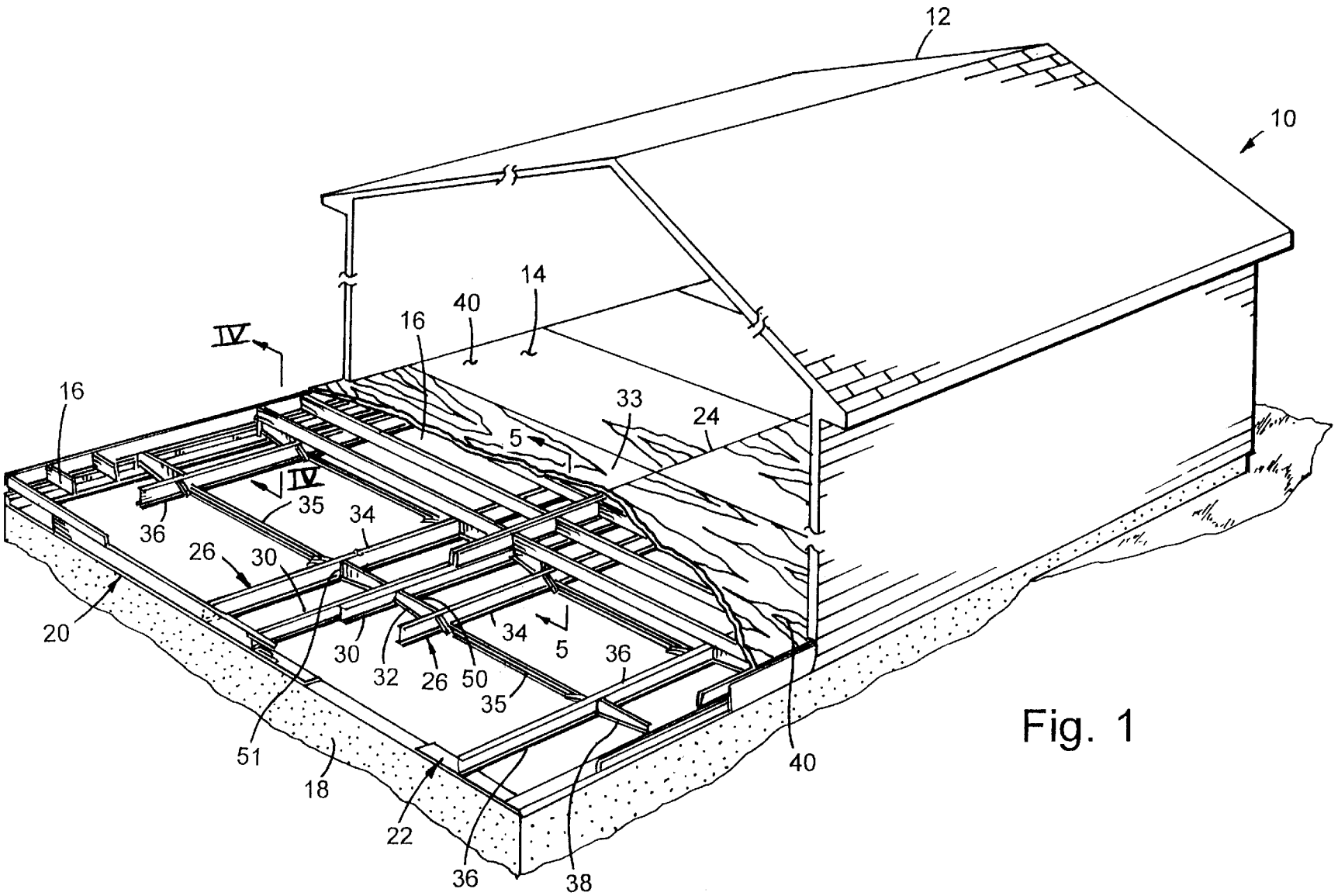
FIG. 1 is a perspective view of the floor frame assembly of the present invention shown attached to a compatible unit to form a unified structure adapted to be placed over a foundation, having the superstructure and the floor structure partially cut away.

Referring to the drawings, and particularly to FIG. 1, a modular housing unit 10 assembled according to the present invention includes a conventional superstructure 12 enclosing a conventional floor 14, e.g., a wooden floor, supported by a number a floor joists 16, all of which is placed on a foundation 18 of poured concrete, concrete block, or other conventional construction. Housing unit 10 is formed from two halves 20, 22 which are joined along mating line 24. Each half includes a floor support frame 26 that includes a number of longitudinally extending elongated floor support I-beams 29, 30, 34 and 36, and an elongated outer side floor support beam 99 (FIG. 2) that does not include a vertical web and that extends generally coincidentally with a section of the perimeter of unit 10. One beam 30 extends along a mating line 24 and is joined to a corresponding beam 29 from the neighboring half. A. connection 31 between beam 30 and corresponding beam 29 from the neighboring unit is discussed in further detail below.

A plurality of transverse supports 32 connect I-beam 30 to an adjacent beam 34 for supporting the central section 33 of floor 14. In a similar fashion, a plurality of outer transverse edge supports 38 extend outwardly from outer I-beam 36 and are connected between I-beam 36 and outer side beam 99 to support an edge section 40 of floor 14. Outer I-beam 315 is connected at intervals to adjacent beam 34 by a plurality of stringers or braces 35.

Figure 2:
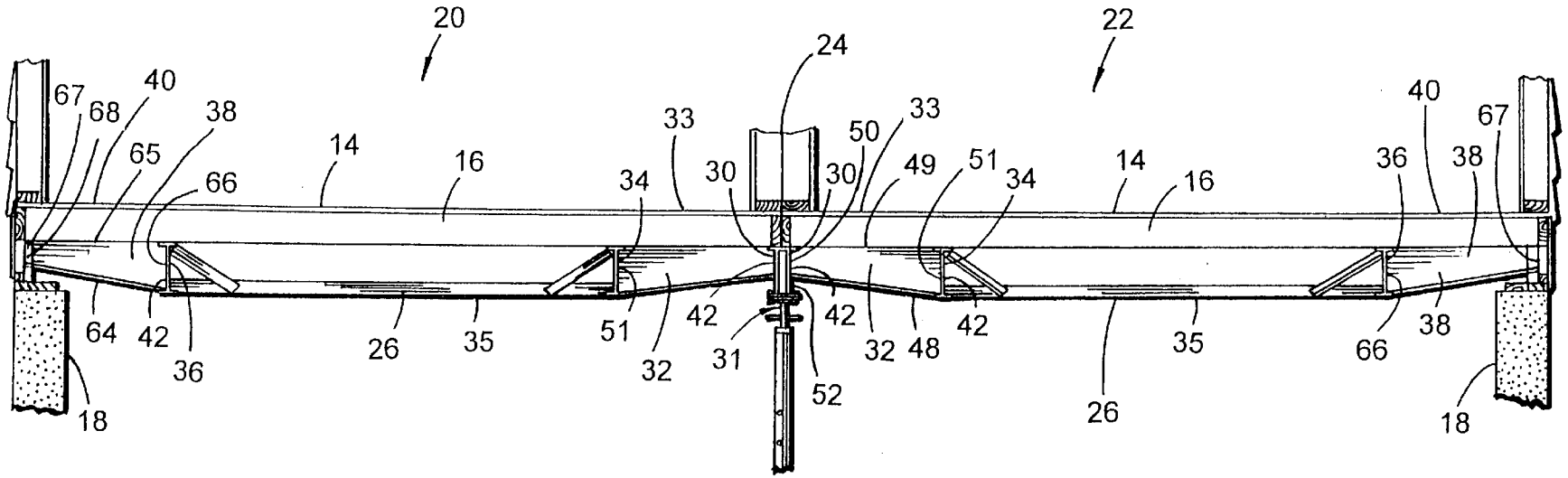
FIG. 2 is a cross-sectional view of the floor frame assembly shown in FIG. 1, again showing the frame of the present invention attached to a compatible unit.
Figure 3:
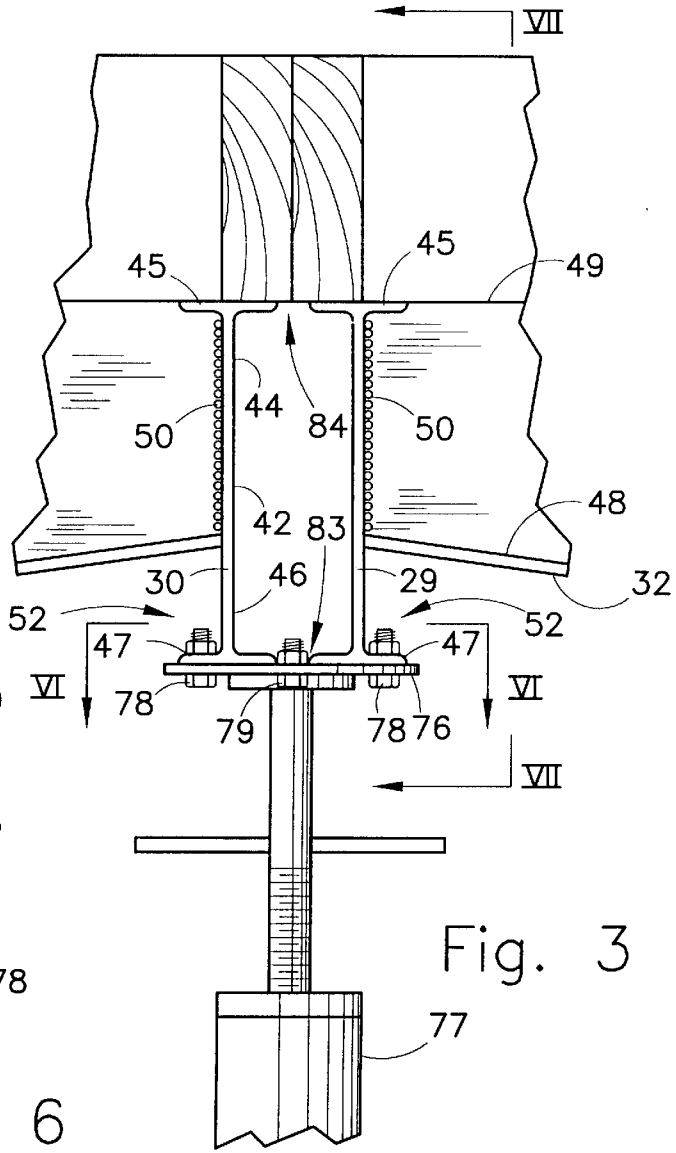
FIG. 3 is a fragmentary cross-sectional view of the connection along the mating line between two compatible units

As shown in FIGS. 2 and 3, I-beams 29, 30, 34, and 36 each include a generally vertical web 42 with an upper end 44 that terminates in a generally horizontal top flange 45, and a lower end 46 that terminates in a generally horizontal bottom flange 47. Transverse supports 32 include a lower edge 48 and an upper edge 49, and a pair of substantially vertical joining edges 50, 51, connected to the webs 42 of I-beams 30 and 34, respectively. As best seen in FIG. 2, the vertical length of joining edge 50 is substantially less than the height of web 42 of beam 30 such that lower end 46 of beam 30 is exposed, thereby creating a gap 52 between the lower edge 48 of transverse support 32 and the lower end 46 of beam 30 to allow the on-site labor to manipulate tools in that immediate area when assembling the frame to jack post 77 as described below.

Figure 7:
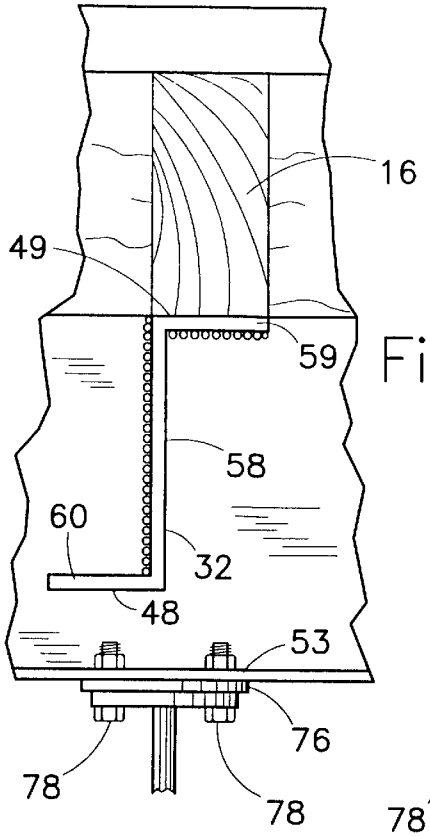
FIG. 7 is a fragmentary cross-sectional view taken along section lines VII—VII of FIG. 3.

Transverse supports 32 preferably include a central section 58 (FIG. 7) and upper and lower oppositely extending longitudinal sections 59, 60, respectively, that extend orthogonally to central section 58. Upper section 59 substantially forms upper edge 49, while bottom section 60 substantially forms lower edge 48. A floor joist 16 overlies each transverse support 32 and is connected at intervals to upper section 59 of transverse support 32 with lag bolts (not shown), or similar conventional connecting means.

Figure 4:
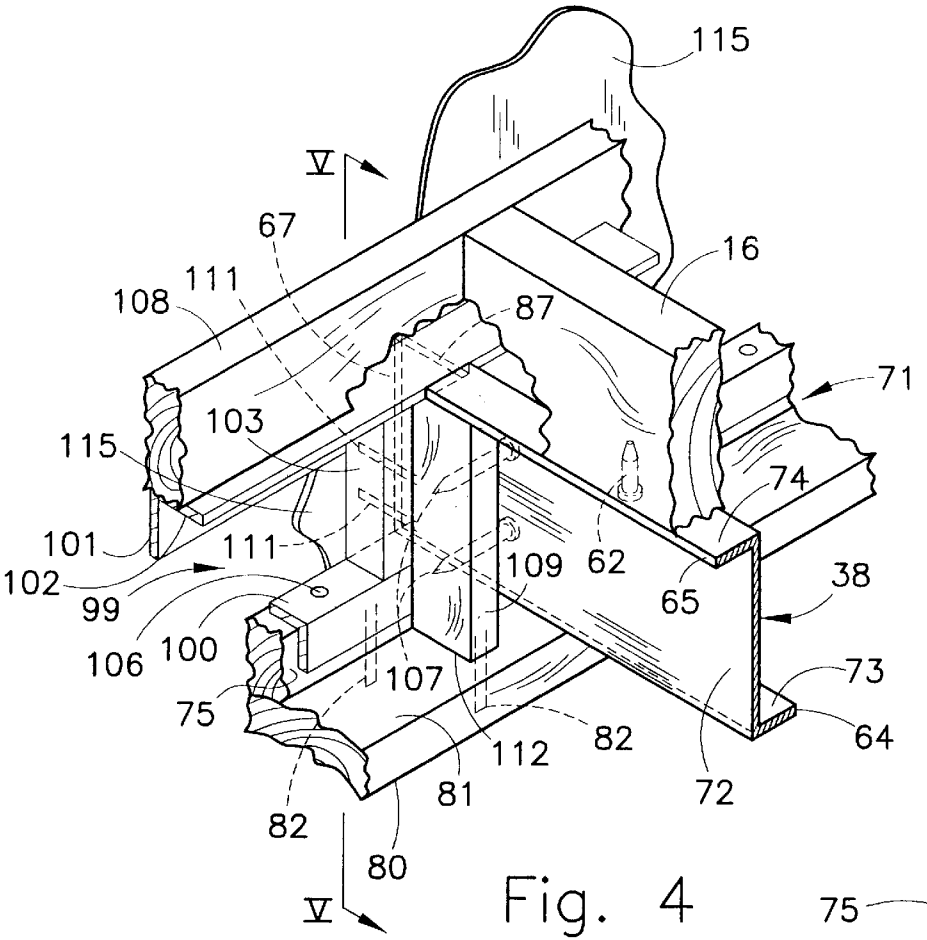
FIG. 4 is a fragmentary perspective view of the outer edge section of the floor structure taken along section lines IV—IV of FIG. 1.
Figure 5:
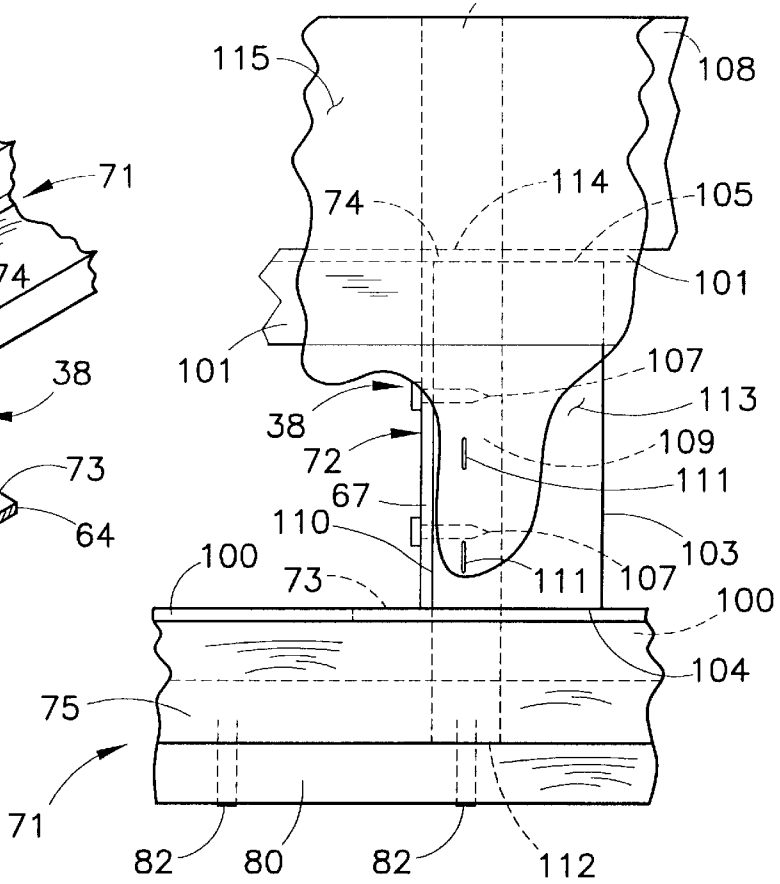
FIG. 5 is a fragmentary cross-sectional view taken along section lines V—V of FIG. 4.

As shown in FIGS. 2, 4 and 5, transverse edge supports 38 include a lower edge 64 and an upper edge 65, and a pair of substantially vertical end edges 66, 67. Vertical edge 66 is attached to web 42 of outer I-beam 36, while edge 67 (FIGS. 2 & 5) overlies a section of the perimeter of foundation 18. Each transverse edge support 38 preferably includes a vertical central section 72 and lower and upper oppositely extending elongated sections or flanges 73, 74, respectively, that extend orthogonally to central section 72. Lower section 73 substantially forms the bottom edge 64, while upper section 74 substantially forms the upper edge 65 of transverse edge supports 38.

With further reference to FIGS. 4 & 5, a pair of generally parallel and spaced angled brackets 100, 101 together function as a web-less outer side beam 99. Preferably, brackets 100, 101 extend coincidentally in a vertical plane along the longitudinal perimeter of unit 10, generally parallel to and spaced from longitudinal I-beams 29, 30, 34 and 36. Angled brackets 100, 101 are orthogonally attached to lower and upper elongated sections 73, 74, respectively, of each transverse edge support 38 of frame 26 in conventional fashion (for example, by welding). Preferably, upper section 74 of support 38 includes a notch 87 formed adjacent edge 67 such that a leg 102 of angled bracket 101, when attached to support 38, is in the same plane as upper section 74. Edge supports 38 are tapered as they extend outwardly, such that when supports 38 are connected to beam 99, the height of beam 99 (i.e., the perpendicular distance between angled brackets 100, 101) generally corresponds to the height of edge 67 of transverse edge support 38.

Also shown in FIG. 4 is a sill plate assembly 71 attached to foundation 18 (described below) that includes a first leg 75, extending generally perpendicularly relative to the plane of the floor 14, and a second leg 80 arranged orthogonally to leg 75 and attached thereto with conventional fasteners, e.g., nails or staples (not shown). At the factory, lower angled bracket 100 is mated with vertical leg 75 of sill plate assembly 71, and fasteners, e.g., screws or nails, are used to secure bracket 100 to leg 75. Notably, angle member 100 of floor support frame 26 can be readily connected to leg 75, without having to crawl underneath frame system 26 or awkwardly attempt to tighten the fasteners, because the fasteners can be secured to a plurality of spaced openings 106 from outside floor support frame 26. Also, when assembled, upper angled bracket 101, which is attached to upper longitudinal section 74, is positioned in abutting relationship with outer floor support member 108 (preferably, a two-by-six) such that support frame 26 is securely sandwiched between the floor and the foundation at the perimeter of housing unit 10.

To further unitize the assembly, floor joists 16 are collectively and orthogonally attached to floor support member 108 in a position such that joists 16 can be readily connected, at spaced intervals, to upper horizontal section 74 of a corresponding transverse edge support 38 with lag bolts 62 or other similar fasteners. As a result, by collectively connecting each support 38 between beam 99 and I-beam 36 and further to a joist 16, floor support frame 26 is unitized. In such an arrangement, supports 38 are collectively loaded such that the overall integrity of the structure of system 26 is improved.

As shown in FIGS. 4 and 5, to provide additional support for frame system 26, and more particularly transverse supports 38, a first stabilizing or compression member 103 is installed adjacent end edge 67 of each transverse support member 38, between angled brackets 100, 101, such that a surface 110 of block 103 abuts central section 72. Compression member 103 is preferably a 2×4 having a height defined by the perpendicular distance between generally parallel and spaced angled brackets 100, 101 because its opposed ends 104, 105 (FIG. 5) abut the generally horizontal sections of upper and lower angled brackets 100, 101, respectively. Compression member 103 also includes a surface 113 that provides a backing for the seams in a sheathing 115 that covers the outside of the frame/floor assembly. In the preferred embodiment, one compression member 103 is associated with each transverse support 38 to strengthen the ends of the transverse edge supports 38.

A plurality of stabilizing or anti-rotation members 109 are arranged orthogonally to a corresponding compression member 103 associated with a particular transverse edge support 38. Generally, anti-rotation member 109 prevents sill plate assembly 71 from rotating relative to foundation 18 as pressure is applied thereto, for example, during back filling of earth against foundation wall 18. Anti-rotation member 109 includes a first end 112 arranged flush with a surface 81 of second leg 80 of sill plate assembly 71, and a second end 114 opposite first end 112 arranged flush with the bottom surface of upper section 74 of support 38. Each anti-rotation member 109 is connected to central section 72 of a corresponding support 38 with conventional fasteners 107, such as screws, that can be attached from outside the perimeter of frame 26. To secure member 103 and maximize the collective stability afforded by members 103, 109, anti-rotation member 109 is initially attached to support 38 and, thereafter, compression member 103 is attached to anti-rotation member 109 with fasteners 111, e.g., staples, that extend through each member 103 into a corresponding member 109. Also, fasteners 82, e.g., staples, are employed to couple member 80, preferably through its bottom, to member 75 and block 109. Notably, after securing each member 103 to each member 109, sheathing 115 is placed around the perimeter of housing unit 10 such that it is readily secured to members 71, 103, and 108 with glue and staples.

Figure 6:
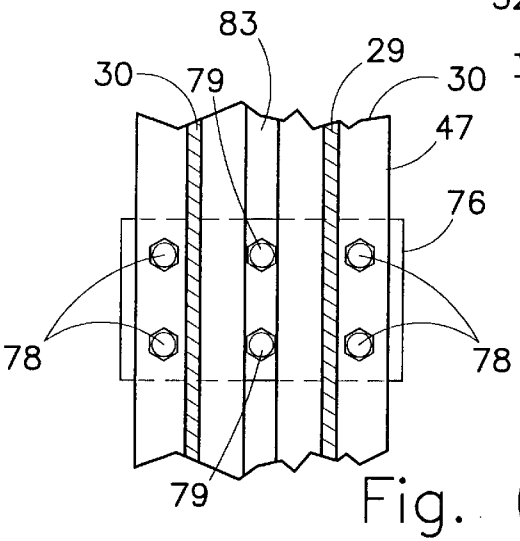
FIG. 6 is a fragmentary cross-sectional view taken along section lines VI—VI of FIG. 3.

FIGS. 3 and 6 illustrate a connection 31 between I-beam 30 and the corresponding I-beam 29 from the neighboring unit. Connection 31 includes a plate 76 that spans at least the combined width of bottom flange 47 of beam 30 and bottom flange 47 of neighboring beam 29. Plate 76 permits both beams to be supported over a common means of support, such as a conventional jack post or column 77, such that a gap 83 exists between bottom flanges 47 and a gap 84 exists between the top flanges of I-beams 30, 29. Preferably, floor bolts, rivets, or other conventional fasteners 78 sandwich and connect bottom flanges 47 to jack post 77. In addition, a pair of fasteners 79 are included for further securing plate 76 to jack post column 77 in the area defined by gap 83 between I-beams 30, 29.

To assemble housing unit 10, each half 20, 22 is constructed at the factory over frame 26 and includes approximately half of superstructure 12 and floor 14, as well as half of sill plate assembly 71. One or more axles (not shown) is attached to each half, which enables each half to be separately towed to a home site. At the home site, the axles are first removed, then frame 26, for each half 20, 22, is juxtaposed on foundation 18 so that sill plate assembly 71 is supported on foundation 18 and flanges 47 of I-beams 30, 29 of each half of the frame lie spaced from each other along mating line 24. One or more columns 77 is positioned below beam 30 such that connection 31 can be completed by fastening plate 76 to bottom flanges 47 of beam 30 and to neighboring beam 29. The gap 52 between the lower edge 48 of support 32 and the bottom flanges 47 of beams 29, 30 facilitates easy access to fasteners 78 for ready completion of connection 31. On the outside edges of the modular unit, sill plate assembly 71 is tied down to foundation 18 by a number of tie down straps (not shown) as is common in the industry, and the roof, walls, and floor along mating line 24 are finished to form a single modular unit 10.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A unitized floor support system for a manufactured home having a perimeter, the unitized floor support system comprising:

a plurality of longitudinally extending beams extending in substantially parallel spaced relationship, said outer longitudinal beam comprising upper and lower longitudinally extending angled members extending in a generally parallel spaced relationship;

a plurality of transverse beams extending orthogonally between adjacent ones of said longitudinally extending beams, each transverse beam having opposed ends coupled to said adjacent longitudinal beams, wherein said plurality of transverse beams includes a plurality of tapered outer transverse beams each coupled to an outer one of said longitudinal beams at a first of said opposed ends, and each said transverse beam having a generally vertical central section and first and second elongated flanges extending orthogonally to and oppositely from said central section, said first elongated flange having a lower surface, said outer longitudinal beam extending generally coincidentally with a section of said perimeter of the manufactured home and said upper and lower angled members of said outer longitudinal beam orthogonally coupled to said first and second elongated flanges of said outer transverse beam, respectively, at said first end of said opposed ends of each outer transverse beam; and a plurality of stabilizing members, each said stabilizing member arranged adjacent to a corresponding one of said outer transverse beams, said stabilizing members including a first stabilizing member arranged orthogonally between said upper and lower angled members of said outer longitudinal beam and a second stabilizing member having a generally vertical body and first and second opposed abutting ends, said first abutting end contacting a section of a sill plate assembly, said second abutting end contacting said lower surface of said first elongated flange and said generally vertical body contacting said generally vertical central section of said corresponding outer transverse beam, the sill plate assembly being attached to a foundation for the manufactured home at the perimeter of the manufactured home.

2. The floor system as defined in claim 1, wherein said first and second stabilizing members are connected to each other in orthogonal relationship, and said second stabilizing member is attached to said generally vertical central section of said corresponding outer transverse beam.

3. The floor support system as defined in claim 1, further including a plurality of said second stabilizing members with one associated with a corresponding one of said outer transverse members.

4. The floor support system as defined in claim 1, wherein said second stabilizing member is a two-by-four wooden member arranged orthogonally to said first stabilizing member.

5. The floor support system as defined in claim 1, wherein said first stabilizing member is a two-by-four wooden member having a height generally defined by a perpendicular distance between said upper and lower angled members.

6. An improved floor support system for a manufactured home of the type having a perimeter and in which a plurality of longitudinally extending I-beams extending in substantially parallel spaced relationship are provided, some of which are connected to a plurality of transverse beams extending orthogonally to the longitudinal I-beams, each transverse beam having one end and an opposite end coupled to adjacent longitudinal I-beams, respectively, wherein at least some of the transverse beams are continually tapered in height such that the one end is substantially the same height as an adjoining longitudinal I-beam and the opposite end has a height greater than about one-half the height of an adjoining longitudinal I-beam and less than the height of the longitudinal I-beam, and wherein the system further includes a plurality of spaced outer transverse beams each having first and second opposed ends, the first end coupled to and extending outwardly from an outer one of the longitudinal I-beams, the outer transverse beams being tapered in height with the first end having a height substantially the same as the outer one of the longitudinal I-beams, each of said outer transverse beams including a generally vertical elongated central section defining generally elongated first and second edges, and first and second elongated sections extending orthogonally to said first and second edges. respectively, said elongated sections having an upper and lower surface, the improvement comprising:

at least one outer side beam extending longitudinally and generally coincidentally with a section of said perimeter of the manufactured home, said outer side beam connected to the second end of each outer transverse beam; and a pair of stabilizing members arranged orthogonally to each other, each said pair coupled to an end of a corresponding one of the outer transverse beams and including a plurality of first stabilizing members each arranged orthogonally to said outer side beam and adjacent to said corresponding outer transverse beam, each said first stabilizing member having opposed ends with each end abutting a different section of said side beam, and a plurality of second stabilizing members each orthogonally connected to a corresponding one of said first stabilizing members, each of said second stabilizing members having a generally vertical body and first and second opposed abutting ends, said first abutting end of said second stabilizing member contacting a section of a sill plate assembly, said second abutting end of said second stabilizing member contacting said lower surface of said first elongated section and said generally vertical body of said second stabilizing member extending along and contacting said generally vertical central section of said corresponding outer transverse beam.

7. The floor support system as defined in claim 6, wherein said outer side beam includes upper and lower longitudinally extending angled members extending in generally parallel spaced relationship, said upper and lower angled members orthogonally coupled to said first and second elongated sections, respectively, at the second end of each outer transverse beam.

8. A method of mounting a frame assembly for a manufactured home on a sill plate assembly coupled to a foundation for the home, comprising the steps of:

using a frame structure having a plurality of longitudinally extending spaced beams and a plurality of spaced transverse supports, including a plurality of outer transverse supports each having a generally vertical central section, first and second elongated sections extending orthogonally to said vertical central section, and opposed ends orthogonally attached to adjacent ones of said longitudinal beams, wherein said longitudinal beams include at least one outer beam comprised of upper and lower generally parallel and spaced angled members attached to at least one of said plurality of outer transverse supports;

using a plurality of first stabilizing members each having a generally vertical body and first and second opposed abutting ends;

fastening each said first stabilizing member to a corresponding one of said outer transverse supports from outside the manufactured home such that one of said abutting ends abuts a section of the sill plate assembly, the other of said abutting ends abuts and supports from beneath said first elongated section of said corresponding outer transverse support and said vertical body is adjacent to and reinforces said generally vertical section of said corresponding outer transverse support;

using a plurality of second stabilizing members each having a first and second opposed ends;

fastening each said second stabilizing member orthogonally to a corresponding one of said first stabilizing members from outside the manufactured home, such that said first and second opposed ends abut a different one of said upper and lower angled members; and fastening said lower angled member to the sill plate assembly from outside the manufactured home.

9. A unitized floor support system for a manufactured home having a perimeter, the unitized floor support system comprising:

a plurality of longitudinally extending beams extending in substantially parallel spaced relationship, said outer longitudinal beam comprising upper and lower longitudinally extending angled members extending in a generally parallel spaced relationship;

a plurality of transverse beams extending orthogonally between adjacent ones of said longitudinally extending beams, each transverse beam having opposed ends coupled to said adjacent longitudinal beams, wherein said plurality of transverse beams includes a plurality of tapered outer transverse beams each coupled to an outer one of said longitudinal beams at a first of said opposed ends, and each said transverse beam having a generally vertical central section and first and second elongated flanges extending orthogonally to and oppositely from said central section, said first elongated flange having a lower surface, said outer longitudinal beam extending gene rally coincidentally with a section of said perimeter of the manufactured home and said upper and lower angled members of said outer longitudinal beam orthogonally coupled to said first and second elongated flanges of said outer transverse beam, respectively, at said first end of said opposed ends of each outer transverse beam; and a plurality of stabilizing members, each said stabilizing member arranged adjacent to a corresponding one of said outer transverse beams, said stabilizing members including a first stabilizing member arranged orthogonally between said upper and lower angled members of said outer longitudinal beam and a second stabilizing member arranged orthogonally to said first stabilizing member and having a generally vertical body and first and second opposed abutting ends, said second stabilizing member fabricated from a section of a two-by-four wooden length, said first abutting end contacting a section of a sill plate assembly, said second abutting end contacting said lower surface of said first elongated flange and said generally vertical body contacting said generally vertical central section of said corresponding outer transverse beam, the sill plate assembly being attached to a foundation for the manufactured home at the perimeter of the manufactured home.

* * * * *

UNITED STATES PATENT AND TRADEMARK OFFICE

CERTIFICATE OF CORRECTION

PATENT NO. : 6,076,311
DATED : June 20, 2000
INVENTOR(S) : Robert E. Godfrey

It is certified that error appears in the above-identified patent and that said Letters Patent is hereby corrected as shown below:

On the Title page insert - - [73] Assignee: Schult Homes Corporation, 221 U.S. 20 West, Middlebury, Ind. 46540

Col. 1, line 38;

"Corp," should be - - Corp. - -.

Col. 3, line 64;

"I-beam 315" should be - - I-beam 36 - -;

Col. 9, Claim 9, line 13;

"gene rally" should be - - generally - -.

Signed and Sealed this

First Day of May, 2001

*Attest:*

Nicholas P. Godici

NICHOLAS P. GODICI

*Attesting Officer*

*Acting Director of the United States Patent and Trademark Office*